United States Patent [19]

Nyman

[11] 4,266,368

[45] May 12, 1981

[54] DEVICE FOR GENERATING A SYNCHRONOUS SOUND REFERRING TO A MODEL RAILWAY ENGINE

[75] Inventor: Bo Nyman, Stockholm, Sweden

[73] Assignee: Alice Nyman, Stockholm, Sweden

[21] Appl. No.: 64,435

[22] Filed: Aug. 7, 1979

[51] Int. Cl.[3] ..... A63H 33/26

[52] U.S. Cl. ..... 46/232

[58] Field of Search ..... 46/227, 232; 104/296, 104/297

[56] References Cited

U.S. PATENT DOCUMENTS

| | | | |
|---|---|---|---|
| 2,882,834 | 4/1959 | Smith | 104/296 |
| 3,061,973 | 11/1962 | Oberdorf | 104/297 X |
| 3,425,156 | 2/1969 | Field | 46/232 |
| 4,160,339 | 7/1979 | Dankman et al. | 46/227 |

FOREIGN PATENT DOCUMENTS

| | | | |
|---|---|---|---|
| 1436814 | 5/1976 | United Kingdom | 46/232 |

*Primary Examiner*—F. Barry Shay

*Attorney, Agent, or Firm*—LeBlanc, Nolan, Shur & Nies

[57] ABSTRACT

A model railway engine carries a loudspeaker which is connected via the running rails to an electronic circuit which drives the loudspeaker to produce sounds simulating a real engine. To achieve synchronization of the sounds with the rotation of the engine wheels, a light diode on the engine emits light which is reflected off the inside of a wheel of the engine onto a phototransistor. The reflecting surface is marked to produce the desired pattern of light pulses at the phototransistor, which is connected to the electronic circuit.

2 Claims, 3 Drawing Figures

DEVICE FOR GENERATING A SYNCHRONOUS SOUND REFERRING TO A MODEL RAILWAY ENGINE

BACKGROUND OF THE INVENTION

Figure 1:
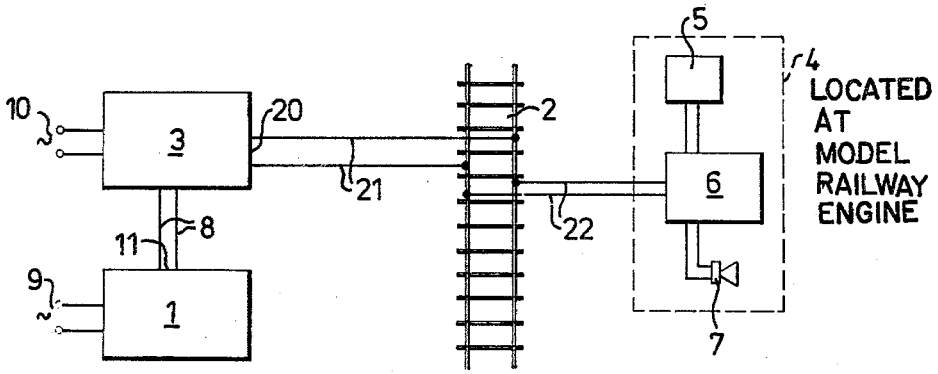

This invention relates to a device for generating a synchronous sound, which relates to a model railway engine.

With model railways it is desired to perceive a sound when an engine runs on the track. It is expressively demanded in connection therewith, that the sound relating to a moving engine shall be synchronous with the movement of the engine, and that the sound shall be adapted to the type of engine in question.

An extremely great number of large and complicated model railways exist today all over the world. Their owners, mostly clubs, demand also that the sound of the model engine should be adapted to the corresponding real engine. From the sound, it should be apparent, for example, whether a steam locomotive has an engine of single, double or triple cylinder type.

It is known previously to use electronic circuits for generating a sound which, for example, corresponds to the "puff-puff" sound of a steam engine. The conventional sound-generating units are intended to be located centrally in a model installation and to feed loudspeakers located in the room where the model railway is arranged. It is also known to emit the generated sound signals as an a-c voltage on the railway rails and to position a miniature loudspeaker in or at the engine in question, so that the sound is emitted from the engine.

It was found very difficult, however, to obtain a sound, which is synchronous with the engine speed, and a sound, of which the number of "puff-puff"s correspond to the mode of operation of the engine type in question.

The present invention offers a very simple device for overcoming the aforesaid difficulty.. The device according to the present invention generates a sound, which correctly corresponds to the real sound of and is synchronous with the speed of the engine.

The present invention, thus, relates to a device for generating a synchronous sound relating to an engine at model railways, comprising a first unit intended to generate by means of electronic circuits sound signals adapted to a certain engine, and to emit the generated sound signals to the engine via conductors, preferably the ones which supply the engine with operation voltage, and a second unit, which is located at the engine and preferably includes a loudspeaker, and which comprises a synchronization set capable to emit pulses in time with the rotation of the engine wheels and connected to said first unit via said conductors, thereby emitting the pulses to said first unit, and that said first unit is capable to emit an a-c voltage corresponding to an emitted pulse or pulses via said conductors to the loudspeaker when a pulse or a number of pulses are emitted from the synchronization set.

The invention is characterized in that said synchronization set comprises a light diode, a phototransistor or a corresponding element and includes marks on the inside of the engine wheels where the light diode and, respectively, phototransistor are located in order to light the inside of the wheel and, respectively, receive light reflected from the inside.

Figure 2:
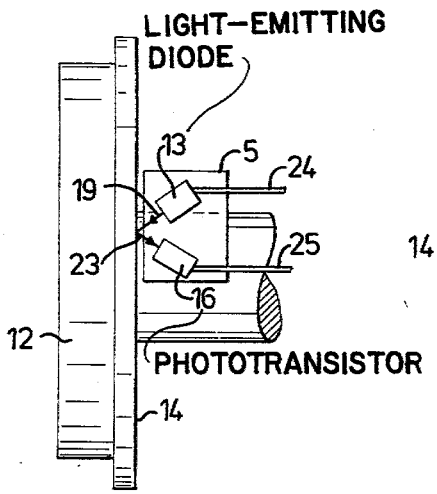
Figure 3:
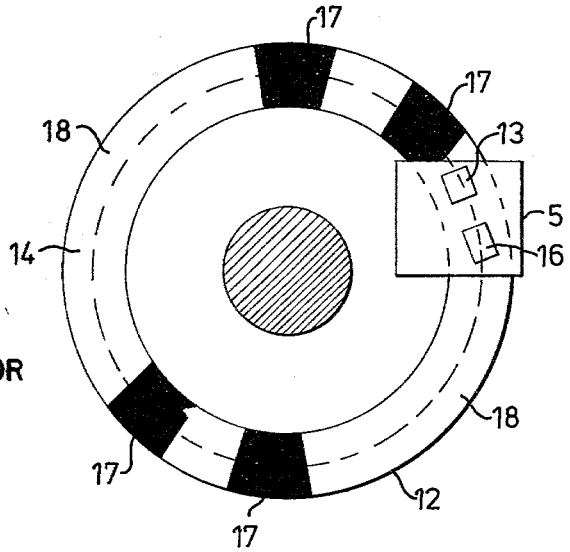

The invention is described in greater detail in the following, with reference to the accompanying drawing, in which FIG. 1 is a schematic block diagram, illustrating application of the invention; and FIGS. 2 and 3 are two different views of a synchronization set for generating synchronized pulses according to the invention.

In FIG. 1, a schematic block diagram for a device at a model railway is shown, to which the invention is applied.

The numeral 1 in FIG. 1 designates a power unit for operating voltage for an engine on rails 2.

The device according to the invention comprises a first unit 3, which, in a manner known per se, is capable to generate by electronic circuits a sound corresponding to a certain engine. The sound can be varied in known manner so as to be adapted thereby to different types of engines. A sound, for example, corresponding to that of a steam engine preferably is generated by a circuit comprising a noise diode.

The device according to the invention further comprises a second unit 4 located at or in the engine. Said second unit comprises a synchronization set 5, an electronic circuit 6 of a kind known per se for driving the synchronization set 5, and a miniature loudspeaker 7.

The first unit 3 and the second unit 4 are interconnected electrically to form a closed circuit via conductors 21, 2, 22, preferably the same conductors, which supply the engine with operating voltage for its travel. According to one embodiment of the invention, which is shown schematically in FIG. 1, the first unit 3 and the second unit 4 are interconnected via the conductors 21, 22 and the rails 2. The conductors 22 are connected to the rails 2 by collector shoes against the rails or the engine wheels, or in other known suitable ways. The power unit 1, which generates operating voltage for the engine, via conductors 8, is connected to the rails 2 via the first unit 3.

The power unit 1 as well as the first unit 3 are fed via inputs 9 and 10, respectively, preferably with alternating current with a voltage of 14–18 V.

The voltage at the output 11 of the power unit 1 preferably is direct voltage, which is varied according to the desired speed of the engine. In the first unit 3 both an a-c voltage signal of high frequency, preferably about 25 kHz, and an a-c voltage signal with a frequency corresponding to the frequency of the desired sound are generated. The frequency of the desired sound is about 20–9000 Hz at a voltage of about 5–7 V. At the output 20 of the unit 3, thus, up to three different voltages exist. The high-frequency a-c voltage preferably is operating voltage for the second unit 4.

The synchronization set 5 together with necessary known electronics 6 is capable to emit pulses in time with the rotation of the engine wheel 12 by entirely or partially breaking and closing, respectively, the high-frequency a-c voltage. The synchronization set 5 comprises a light diode 13, a phototransistor 16 or corresponding elements. The light diode 13 and the phototransistor 16, respectively, are connected to the electronic circuit 6 of the second unit via conductors 24 and 25, respectively. The synchronization set 5 further includes marks 17 preferably made on the inside 14 of one of the engine wheels 12. As appears from FIGS. 2 and 3, the light diode 13 and phototransistor 16 are located close to the periphery of the wheel. The light diode 13 is capable to emit light 19 to the inside 14 of the wheel 12. The phototransistor 16 is located so that light 23 emitted from the light diode against the inside 14 of the wheel 12 is reflected from portions of the inside of the wheel to the phototransistor.

According to a preferred embodiment, the light diode 13 is capable to emit light within the infrared spectrum, and the phototransistor is capable to conduct when it is lighted by light within the infrared spectrum. The advantage hereby gained is great, because the effect of stray light is entirely eliminated. The inside 14 of the wheel 12 normally is bright, and the marks 17 preferably consist of black paint or the like. Modifications in this respect ar covered by the invention. Upon rotation of the wheel 12, thus, the phototransistor emits a signal in the form of a pulse train, in which the pulses correspond to marked sections 17 having been passed and unmarked sections 18. Generated pulses are transferred via the high-frequency a-c voltage to the first unit 3, for example in such a manner that said sound generating circuit is actuated when the phototransistor 16 is conductive. An a-c voltage with a frequency corresponding, for example, to steam sound in the first unit 3 then is emitted from the first unit 3 to the second unit 4 during the conductive period of the phototransistor 16. Said lastmentioned a-c voltage is operation voltage for the loudspeaker 7. Sound, of course, can instead be generated when the phototransistor 16 is not conductive.

The sound generated in the loudspeaker 7, thus, will be fully synchronous with the rotation of the wheel 12, and the sound pulses from the loudspeaker 7 will correspond to the marked sections 17 and, respectively, the unmarked sections 18.

According to a preferred embodiment, the marked sections 17 and the unmarked ones 18 are of such size relation to each other, that the pulses generated at the rotation of the wheel 12 and the sound pulses emitted from the first unit as a function of said pulses correspond to the sound pulses of the machinery of the real engine corresponding to the model engine in question.

It also is possible and lies within the scope of the invention, that a loudspeaker for generating the sound is located in a place other than in or at the engine. Such a loudspeaker possibly is connected via amplifiers to the output 20 of the first unit 3.

As appears from the aforesaid, the present invention overcomes the difficulties referred to in the introductory portion. The invention further permits, by varying the marked and, respectively, unmarked sections on the engine wheel, to generate sound pulses at an optional angle of rotation of the wheels. It is possible hereby to reproduce sound substantially equal to authentic sound.

I claim:

1. In combination with a model railway engine, a device for generating a synchronous sound imitative of a model railway engine, said device comprising a first unit having means including electronic circuits for generating sound signals adapted to imitate a certain engine and capable of emitting the generated sound signals via conductor means which also supply operating voltage to the engine, and a second unit located at the engine, which includes a loudspeaker, said second unit comprising a synchronization set capable of emitting pulses in time with the rotation of the engine wheel, which synchronization set is connected to said first unit via said conductor means and thereby capable of emitting the pulses to the first unit, said first unit being capable of emitting an a-c voltage corresponding to a sound pulse via said conductor means to teh loudspeaker when a pulse or a plurality of pulses are emitted from the synchronization set, characterized in that said synchronization set comprises a light-emitting diode, a phototransistor and marks made on the inside surface of the engine wheel, where the light-emitting diode and, respectively, the phototransistor are located to light said inside surface, and respectively, receive light reflected from the inside surface.

2. The combination as defined in claim 1, characterized in that the light-emitting diode is capable of emitting light within the infrared spectrum, and that the phototransistor is capable of becoming conductive when lighted by light within the infrared spectrum.

* * * * *